US009931599B2

(12) United States Patent
Jensen et al.

(10) Patent No.: US 9,931,599 B2
(45) Date of Patent: Apr. 3, 2018

(54) DELAY SYSTEM FOR A STIRRING MACHINE

(71) Applicant: SUKUP MANUFACTURING CO., Sheffield, IA (US)

(72) Inventors: Thomas J. Jensen, Sheffield, IA (US); Graham Giddings, Sheffield, IA (US); Charles E. Sukup, Dougherty, IA (US)

(73) Assignee: Sukup Manfucaturing Co., Sheffield, IA (US)

( * ) Notice: Subject to any disclaimer, the term of this patent is extended or adjusted under 35 U.S.C. 154(b) by 576 days.

(21) Appl. No.: 14/455,357

(22) Filed: Aug. 8, 2014

(65) Prior Publication Data

US 2016/0038894 A1 Feb. 11, 2016

(51) Int. Cl.

| | |
|---|---|
| ***B01F 15/00*** | (2006.01) |
| ***B01F 7/16*** | (2006.01) |
| ***B01F 3/18*** | (2006.01) |
| ***B01F 7/30*** | (2006.01) |
| ***B01F 13/04*** | (2006.01) |
| ***F26B 9/08*** | (2006.01) |

(52) U.S. Cl.

CPC ..... *B01F 3/18* (2013.01); *B01F 7/302* (2013.01); *B01F 13/045* (2013.01); *F26B 9/085* (2013.01); *B01F 2215/0013* (2013.01)

(58) Field of Classification Search

CPC ..... B01F 7/302; B01F 13/045; B01F 13/047; A01F 25/00; A01F 25/22; F26B 9/085

See application file for complete search history.

(56) References Cited

U.S. PATENT DOCUMENTS

| | | | | |
|---|---|---|---|---|
| 4,248,538 A * | 2/1981 | Sukup | ..... | A01F 25/00 366/261 |
| 5,570,954 A | 11/1996 | Sukup | | |
| 2013/0049975 A1 * | 2/2013 | Heying | ..... | A01F 25/22 340/670 |

* cited by examiner

*Primary Examiner* — Tony G Soohoo
*Assistant Examiner* — Elizabeth Insler
(74) *Attorney, Agent, or Firm* — Zarley Law Firm, P.L.C.

(57) ABSTRACT

A delay system for a stirring machine includes a plurality of vertical stirring augers, supported to a cross tube, with each auger having a tilt switch. A gear motor is connected to the cross tube and moves the cross tube forwardly around a bin. A delay assembly is connected to the tilt switches and the gear motor. The delay assembly shuts off the gear motor when the stirring augers are vertically displaced and starts the gear motor after a time delay once the stirring augers return to a vertical position.

9 Claims, 4 Drawing Sheets

DELAY SYSTEM FOR A STIRRING MACHINE

BACKGROUND OF THE INVENTION

The invention is directed to a delay system for a stirring machine and more particularly to a system that delays forward movement of a cross tube of a stirring machine after stirring augers have returned to a generally vertical position.

Stirring machines for grain bins are well known in the art. Presently, a tilt switch mounted on a vertical auger on a stirring machine shuts off the forward movement of the stirring auger when the stirring auger lags too far behind. This allows the vertical auger to catch up to a more vertical position at which time the gear motor is actuated to start the forward movement of the cross tube.

In tough and wet drying situations, once the stirring augers return to a more vertical position, they may quickly encounter dense grain and be displaced causing another shut down. When the stirring auger remains vertical momentarily, it is better able to clear the dense grain leading to more efficient movement in high moisture and difficult drying situations and fewer shut downs. Thus, a system is needed in the art for a device that addresses these deficiencies.

An objective of the present invention is to provide a delay system for a stirring machine that improves the stirring efficiency.

Another objective of the present invention is to provide a delay system for a stirring machine to improve performance of the stirring augers in high moisture and difficult drying situations.

These and other objectives will be apparent to one of ordinary skill in the art based upon the following written description, drawings, and claims.

SUMMARY OF THE INVENTION

A delay system for a stirring machine includes a plurality of vertical stirring augers, supported on a cross tube, with each auger having a tilt switch. A gear motor is connected to the cross tube and moves the cross tube forwardly around a bin. A delay assembly is connected to the tilt switches and the gear motor. The delay assembly shuts off the gear motor when the stirring augers are vertically displaced and starts the gear motor after a time delay once the stirring augers return to a vertical position.

DETAILED DESCRIPTION OF THE PREFERRED EMBODIMENTS

Figure 1:
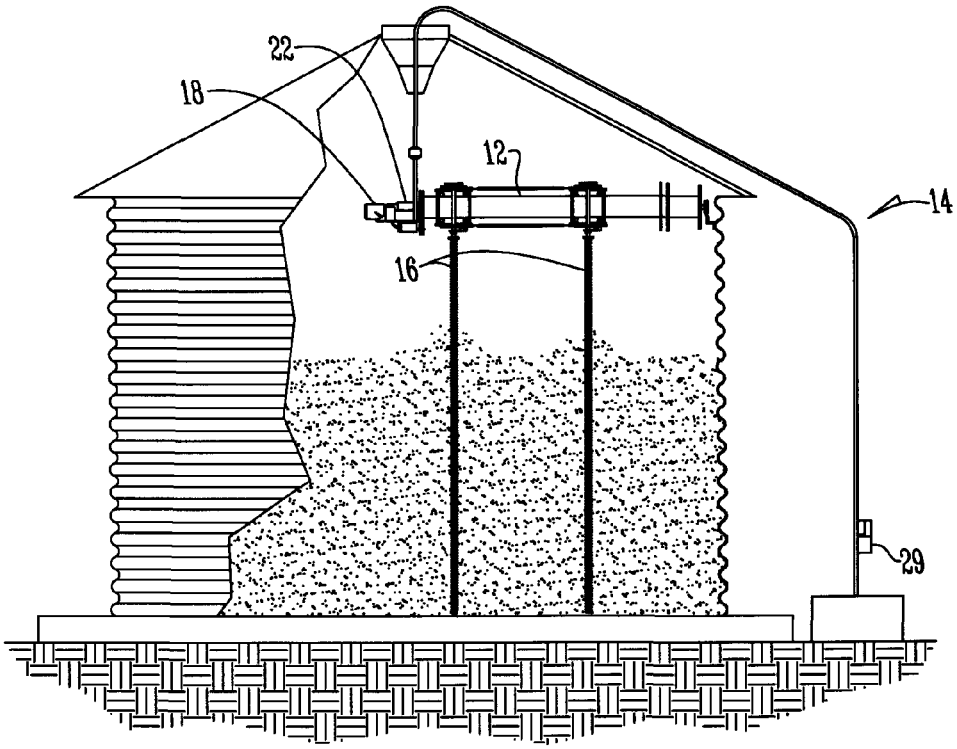
FIG. 1 is a side sectional view of a stirring machine in a grain bin.
Figure 2:
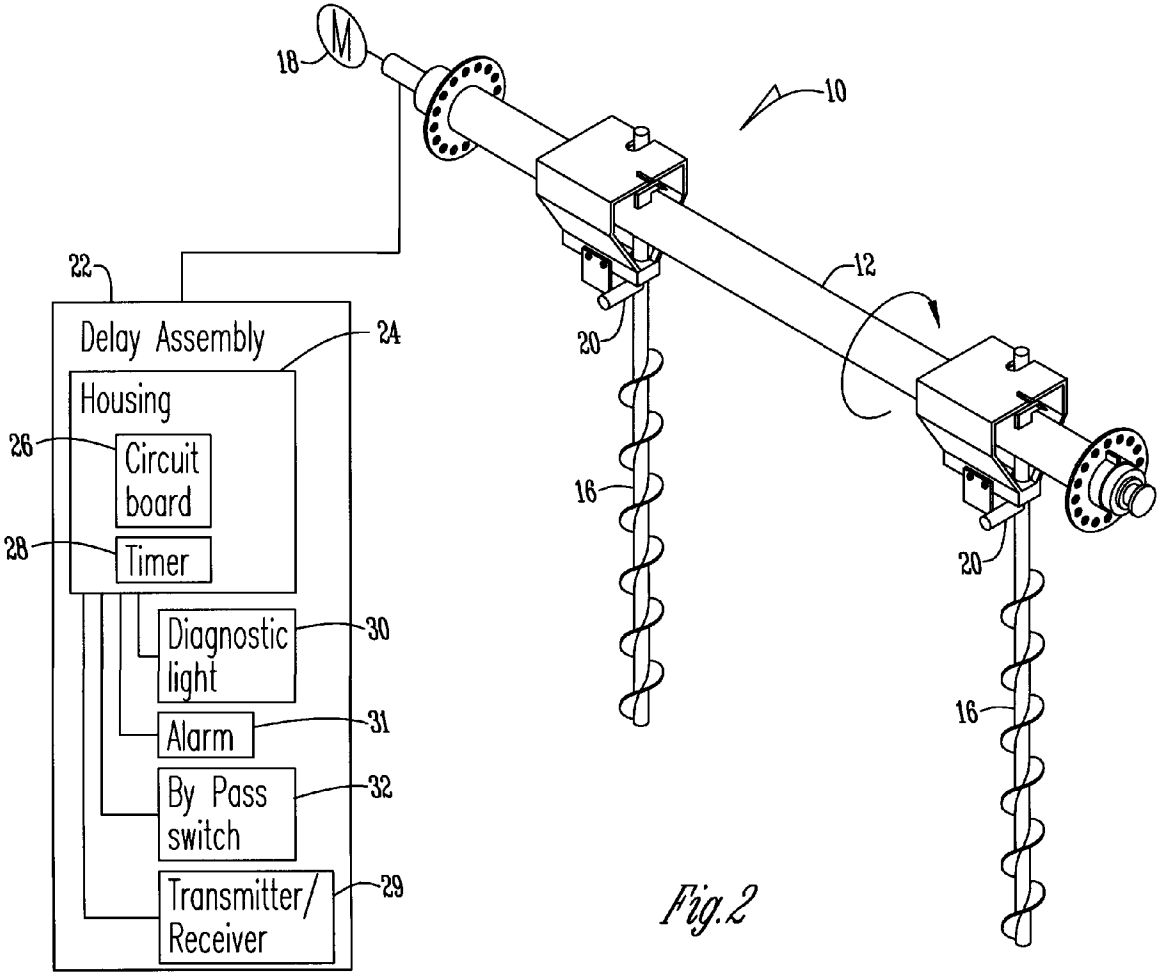
FIG. 2 is a perspective view of a stirring machine.
Figure 3:
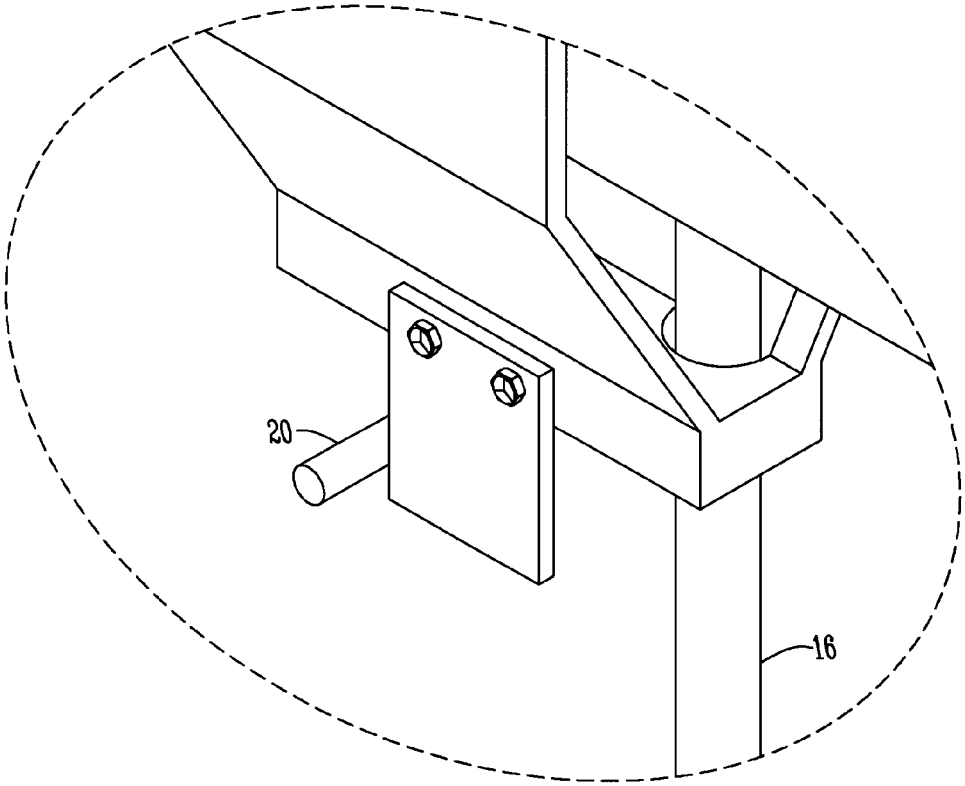
FIG. 3 is a perspective view of a tilt switch assembly.
Figure 4:
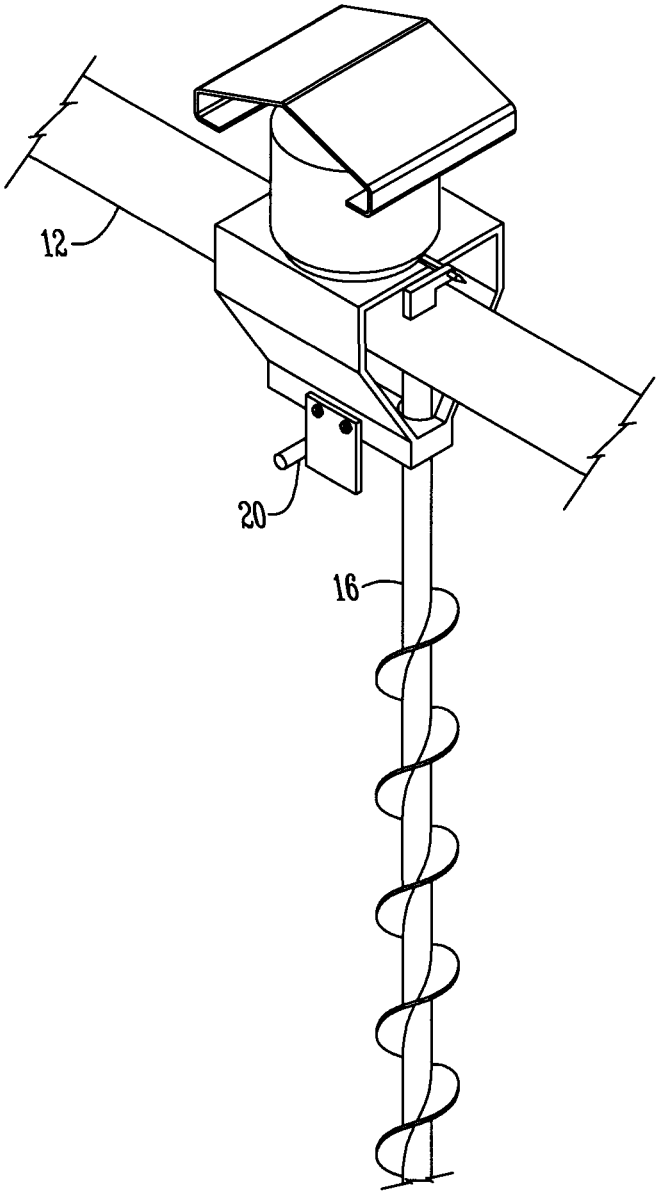
FIG. 4 is a perspective view of a stirring machine.

Referring to the Figures, a stirring machine 10 includes a laterally extending support or cross tube 12, which normally extends radially of a bin 14 in which it is mounted. A plurality of downwardly extending stirring augers 16 are supported by the cross tube 12 and are operatively connected to a gear motor 18. A tilt switch 20 is connected to each auger 16 for detecting when the downward auger 16 lags too far behind the cross tube 12. The tilt switch 20 is electrically connected to a delay assembly 22.

The delay assembly 22 includes a housing 24 that encloses a circuit board 26 and a timer 28. The assembly may also include a transmitter/receiver 29, a diagnostic light 30, an alarm 31 and a by-pass or override switch 32. The transmitter/receiver 29 may be attached to an outer portion of the bin 14, have a transmitter/receiver 29 and be electrically or wirelessly connected to the circuit board 26. The gear motor 18 is also connected to the delay assembly 22.

In operation, the gear motor 18 drives the cross tube 12 around the bin 14 which in turn drives the augers 16 around the bin 14 and laterally on the cross tube 12. Periodically, as the augers 16 encounter wet and heavy grain, the auger 16 will tilt and lag behind the cross tube 12. When this occurs, the tilt switch 20 detects a vertical displacement of the auger 16 and sends a signal to the circuit board 26 of the delay assembly 22. The circuit board 26 then sends a signal to the gear motor 18 which shuts off forward movement of the cross tube 12. Shutting off forward movement of the cross tube 12 allows the stirring augers 16 to catch up and return to a more vertical position. If the stirring augers 16 do not return to a vertical position within an adjustable predetermined time, the circuit board 26 sends a signal activating the alarm 31 and may also shut off the stirring auger 16. The alarm 31 may be wirelessly connected to a remote device such as an operator's phone.

When the stirring auger 16 returns to a near vertical position, the tilt switch sends a signal to the circuit board 26 which in turn sends a signal to the timer 28 which delays forward movement of the cross tube 12. After an adjustable, predetermined time has elapsed, a signal is sent to the gear motor 18 from the timer 28 and forward movement of the cross tube 12 is restored.

Alternatively, when the auger 16 tilts and lags behind the cross tube 12, the tilt switch 20 sends a signal to the circuit board 26, which sends a signal to the timer 28. The timer 28 shuts off power to the gear motor 18 for a predetermined amount of time. Once the predetermined amount of time expires, so long as the auger 16 has returned to a near vertical position, power is returned to the gear motor 18. If not, either a signal is sent to the alarm 31 or the predetermined time delay is reset.

Thus a delay assembly for a stirring machine has been disclosed that, at the very least meets all the stated objectives.

What is claimed is:

1. A delay system for a stirring machine comprising:

a plurality of stirring augers supported by a cross tube and having a tilt switch;

a gear motor connected to the cross tube; and a delay assembly connected to the gear motor and the tilt switch, wherein the delay assembly is configured to delay forward movement of the cross tube after the stirring augers have returned to a near vertical position.

2. The delay system of claim 1 wherein the tilt switch is configured to send a signal to the delay assembly when the tilt switch detects a vertical displacement of the stirring auger such that forward movement of the cross tube is stopped.

3. The system of claim 1 wherein the delay assembly includes a circuit board and a timer within a housing.

4. The system of claim 3 wherein at least one diagnostic light and an override switch are attached to an outer surface of the housing and connected to the circuit board.

5. The system of claim 1 further comprising the delay assembly having an alarm, wherein the alarm is configured to activate if the stirring auger does not return to a near vertical position within an adjustable predetermined amount of time.

6. The system of claim 1 wherein the tilt switch sends a signal to a timer that shuts off power to the gear motor for a predetermined amount of time.

7. The system of claim 1 wherein the delay assembly is wirelessly connected to the gear motor and tilt switch.

8. The system of claim 1 wherein the delay assembly is configured to shut off power to the stirring augers after a predetermined amount of time.

9. A delay system for a stirring machine comprising:

a plurality of stirring augers supported by a cross tube and having a tilt switch;

a gear motor connected to the cross tube;

a delay assembly connected to the gear motor and the tilt switch;

wherein the tilt switch is configured to send a signal to the delay assembly when the tilt switch detects a vertical displacement of the stirring auger such that forward movement of the cross tube is stopped; and wherein the delay assembly is configured to shut off power to the stirring augers if the stirring auger does not return to a near vertical position within an adjustable predetermined amount of time.

* * * * *